US010737902B2

(12) United States Patent
Pai

(10) Patent No.: US 10,737,902 B2
(45) Date of Patent: Aug. 11, 2020

(54) DEVICE AND METHOD FOR STORING AND TRANSPORTING CABLES

(71) Applicant: Samuel Hong-Yen Pai, San Mateo, CA (US)

(72) Inventor: Samuel Hong-Yen Pai, San Mateo, CA (US)

( * ) Notice: Subject to any disclaimer, the term of this patent is extended or adjusted under 35 U.S.C. 154(b) by 0 days.

(21) Appl. No.: 16/158,208

(22) Filed: Oct. 11, 2018

(65) Prior Publication Data

US 2020/0115184 A1 Apr. 16, 2020

(51) Int. Cl.
*B65H 75/36* (2006.01)
*B65H 75/44* (2006.01)
*B65H 75/28* (2006.01)

(52) U.S. Cl.
CPC ..... *B65H 75/362* (2013.01); *B65H 75/28* (2013.01); *B65H 75/4476* (2013.01); *B65H 2701/34* (2013.01)

(58) Field of Classification Search
CPC .. B65D 75/362; B65D 75/4476; B65D 75/28; B65D 2701/34
USPC ..... 242/404.3, 400.1, 405.1
See application file for complete search history.

(56) References Cited

U.S. PATENT DOCUMENTS 2,351,379 A * 6/1944 Wehringer ..... H02G 11/02 174/135
2,533,341 A * 12/1950 Alfano ..... H02G 11/02 24/129 R
D393,411 S * 4/1998 Crowe ..... D3/24
6,003,804 A * 12/1999 Vara ..... B65H 75/42 211/13.1
6,301,752 B1 10/2001 Koppang
D456,692 S 5/2002 Epstein
7,048,222 B1 * 5/2006 Curtiss ..... B65H 75/4476 191/12.2 R
8,167,102 B2 5/2012 Skillman
8,523,098 B2 9/2013 Detweiler
8,528,171 B2 9/2013 Walker
9,257,826 B2 * 2/2016 Ho ..... H02G 11/00
10,179,691 B2 * 1/2019 McCarren ..... B65H 55/00
2004/0182964 A1 * 9/2004 Clark ..... G06F 3/0202 242/400.1
2009/0194630 A1 * 8/2009 Thiyagarajan ..... B65H 75/4473 242/405.1
2013/0037643 A1 * 2/2013 Belyea ..... B65H 75/28 242/118
2013/0152508 A1 * 6/2013 Solomon ..... B65H 54/58 53/430
2016/0050481 A1 * 2/2016 Moats ..... H04R 1/1033 381/384

* cited by examiner

*Primary Examiner* — Robert Sandy
*Assistant Examiner* — Rowland Do
(74) *Attorney, Agent, or Firm* — Dergosits & Noah LLP

(57) ABSTRACT

A device and method for storing cables commonly associated with mobile devices. A platform of the device has two posts around which a cable is wound, and a flexible cover attached to the posts that can fully enclose the cable and platform when closed. While remaining attached to the posts, the cover can be opened to allow access to the cavity for winding or unwinding the cable.

8 Claims, 6 Drawing Sheets

DEVICE AND METHOD FOR STORING AND TRANSPORTING CABLES

TECHNICAL FIELD

The present invention relates to the field of organizing cables and cords, more specifically cables used with mobile devices to allow easier storage and transport.

BACKGROUND

The proliferation of mobile devices has been accompanied by the rapid growth of wired accessories that connect with the mobile devices for a variety of functions, such as data communication, battery charging and audio reproduction. The variety of cables that can be connected to a mobile device are troublesome to store and transport, especially when travelers are in a hurry. The cables can become knotted, entangled with other cables or devices, or damaged, making them difficult to use or unusable.

A number of approaches have been developed to deal with these issues, but they suffer from a variety of deficiencies such as, leaving portions of the cable exposed so that they are subject to damage, being too bulky to fit in a pocket, having a mechanical design that intrudes on the cable winding process, or being easily separated from the cable when the cable is in use.

SUMMARY OF THE INVENTION

A cable storage device is disclosed consisting of a flat oblong platform with posts orthogonal to the plane of the platform at each of the rounded ends of the platform connected to a bi-stable flexible cylindrical cover that meets the oblong platform to create a cavity suitable for storing cables associated with mobile devices. By inverting the flexible cover to its second stable position while remaining attached to the platform, a cable can be wound around the posts such that when the cover is restored to the first position, the cover completely contains the cable, including the cable end connectors.

In one embodiment the cover completely encloses the platform to provide protection from the environment.

In a second embodiment, one or more notches are placed in the cover to allow the cable ends to extend from the proposed invention, allowing excess cable to be stored in the invention while the cable is in use.

In a third embodiment, the posts can retain the cable such that the invention remains attached to the cable regardless of the cover position or amount of cable wrapped around the posts.

In a fourth embodiment, the overall shape of the invention need not be oblong, but any shape consistent with a flexible cover that is bistable to provide protection when closed and easy access when opened. Non-oblong shapes are particularly useful when the ends of the cables are small devices such as earbuds.

In a fifth embodiment, the platform can extend beyond the edges of the cover, providing a cavity on a surface in which to store a cable that is used with a device of which the surface is a part. Examples include vacuum cleaners and power supplies for electronic equipment.

DETAILED DESCRIPTION

Figure 1A:
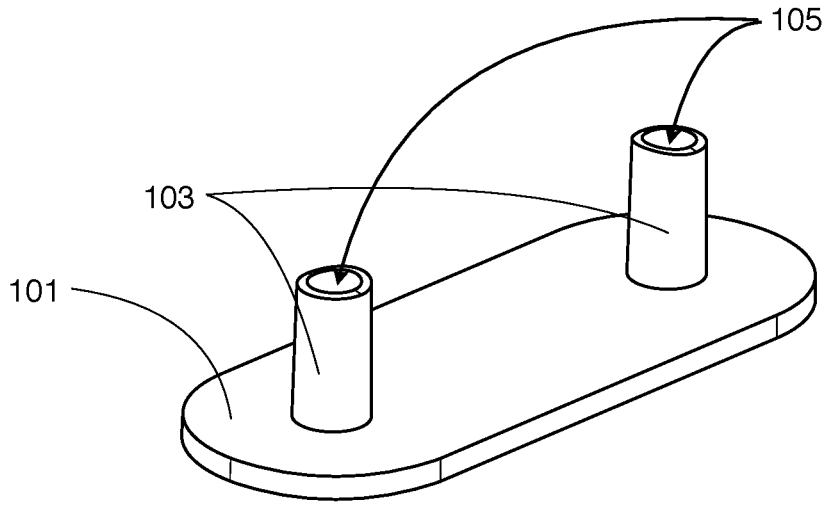
FIG. 1*a* is an orthographic view of the base platform.
Figure 1B:
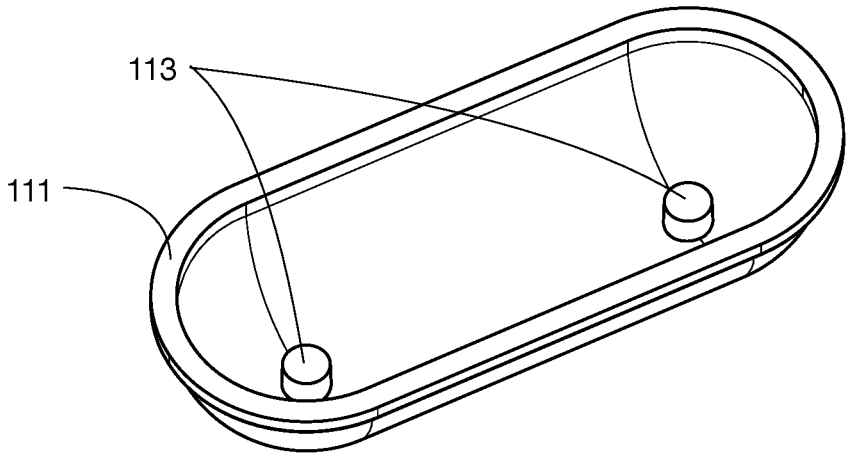
FIG. 1*b* is an orthographic view of the cover interior.
Figure 2A:
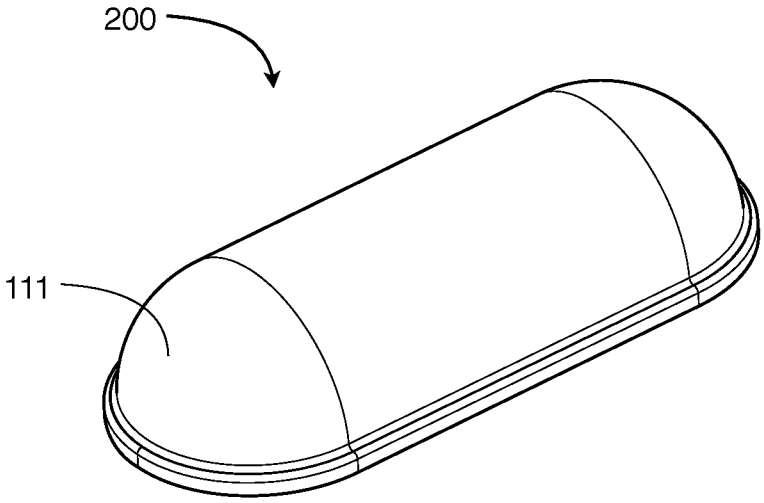
FIG. 2*a* is an orthographic view of an embodiment of the invention in the closed position.
Figure 2B:
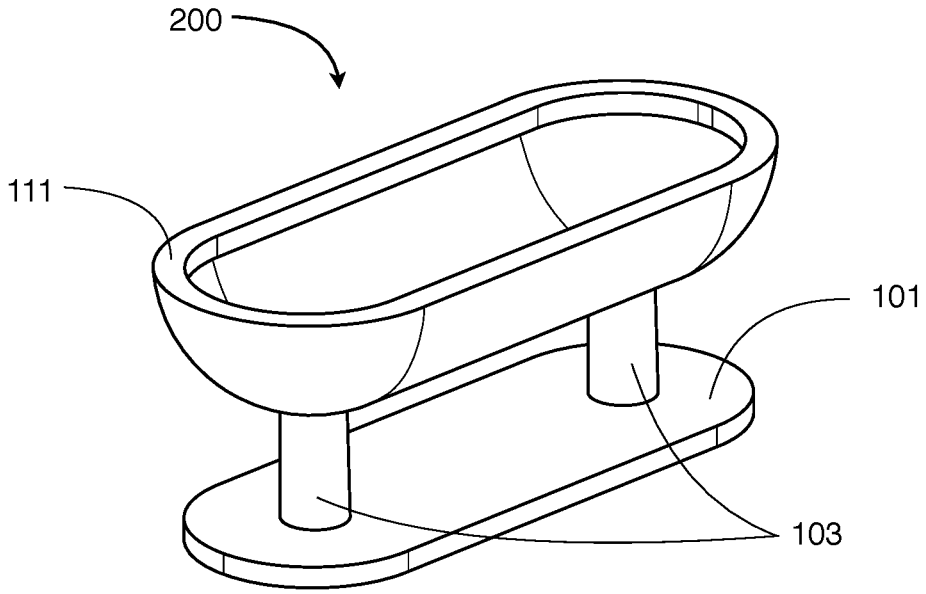
FIG. 2*b* is an orthographic view of the same embodiment in the open position.
Figure 2C:
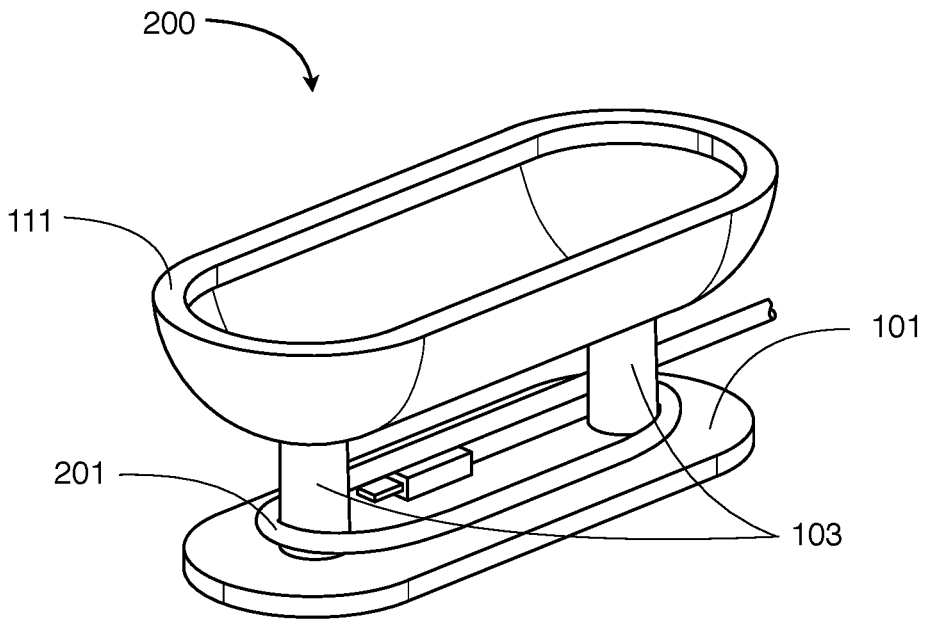
FIG. 2*c* is an orthographic view of the open position with a cable being wound around the end posts.

Referring to FIGS. 1*a* and 1*b*, the basic embodiment consists of an oblong platform (101) with two end posts (103) of appropriate size for the diameter and length of cables to be stored in the invention, and a flexible cover (111) with two bosses (113). The cover bosses (113) insert securely into holes (105) in the posts (103) of the platform (101). This results in an assembly (200) as shown in FIG. 2*a* when cover (111) is in the closed position and as shown in FIG. 2*b* when the cover is in the open position. The flexible cover is stable in either position, so it does not need to be held in either the open or closed position. When open, the cover (111) can serve as a handle while a cable (201) is wound around the posts (103) as shown in FIG. 2*c*; and when the cable is completely wound up, the cover is restored to the closed position to completely cover the cable as shown in FIG. 2*a*.

Figure 3:
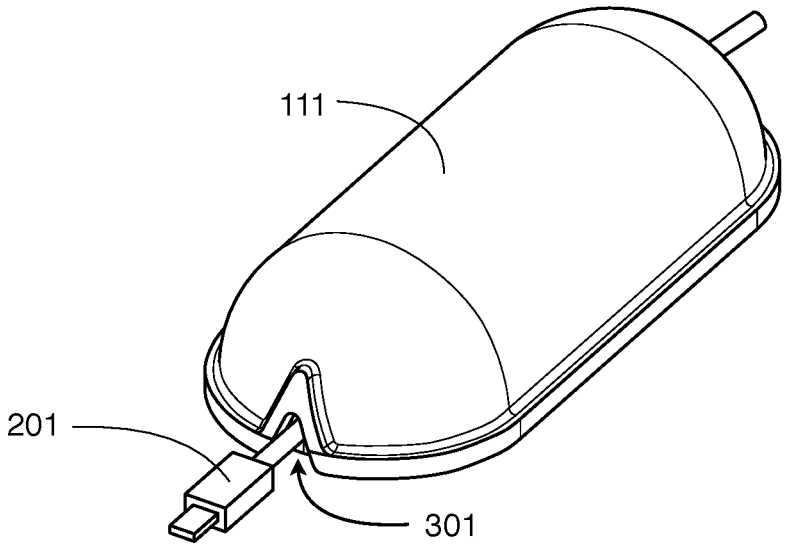
FIG. 3 is an orthographic view of an embodiment of the cover with end notches, providing excess cable storage if required while the cable is in use.

FIG. 3 shows a second embodiment with notches (301) in the cover (111), preferably on the ends, to allow the cable (201) to protrude from the invention when in the closed position. This embodiment allows the invention to store any excess cable while the cable is being used.

Figure 4A:
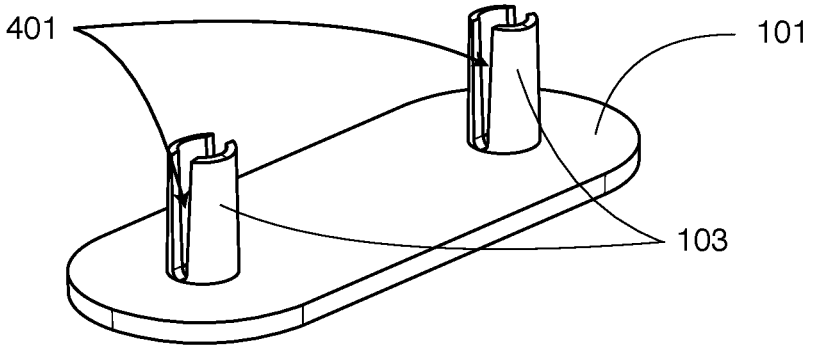
FIG. 4*a* is an orthographic view of an embodiment where the posts are modified to retain a cable.
Figure 4B:
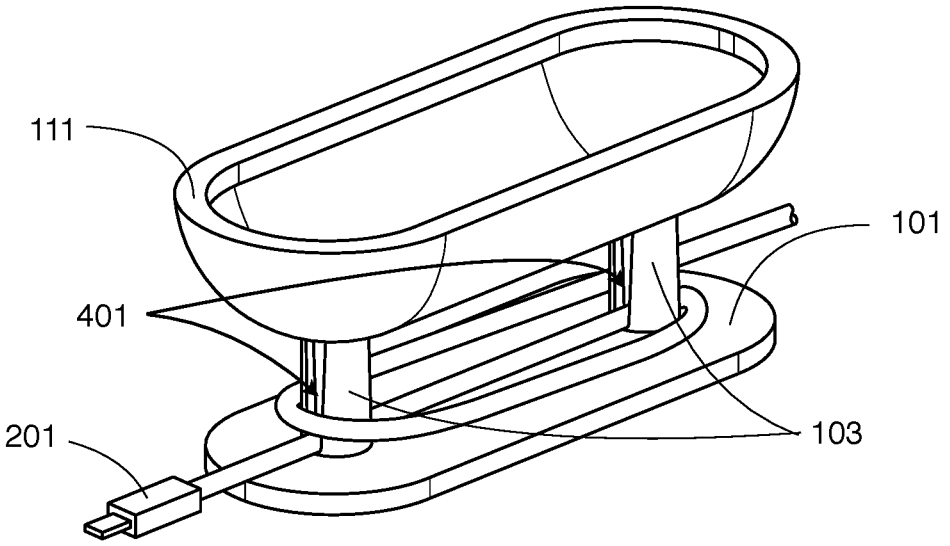
FIG. 4*b* is an orthographic view of the modified posts with cover and the cable to be retained.

FIG. 4*a* shows another embodiment where the posts (103) are modified in such manner as to retain the cable (201) being stored, allowing the invention to stay with the cable when it is in use even when the cover (111) is open or all of the cable is being used. FIG. 4*b* shows how this is accomplished by placing a channel (401) of appropriate size for the cable in the posts (103) and inserting the cable (201) into the channel. The cover (111) is then attached, securing the cable in the channel (401). One or both posts can be used to retain the cable. Storing and retrieving the cable is the same process as the first embodiment.

Figure 5A:
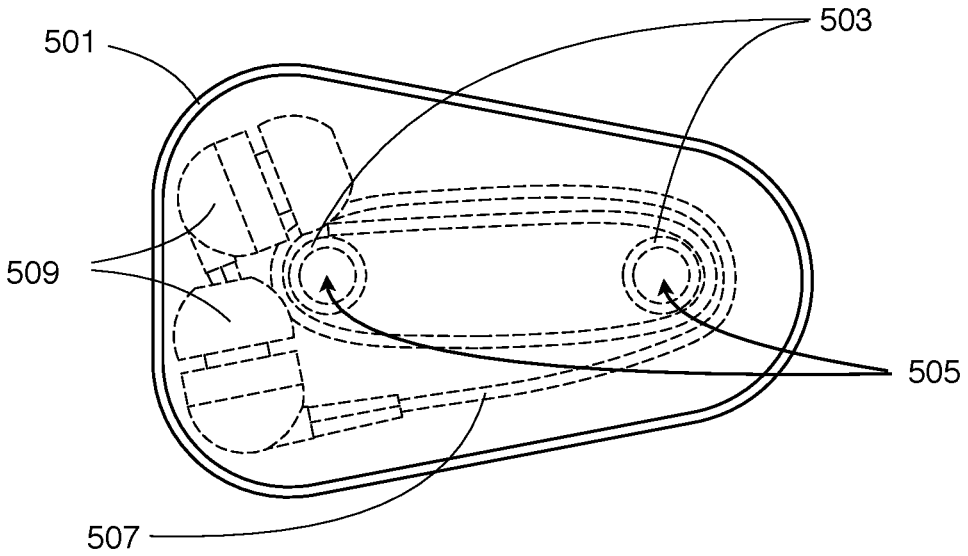
FIG. 5*a* is a top view of a non-oblong shape consistent with use for storage of earbuds.
Figure 5B:
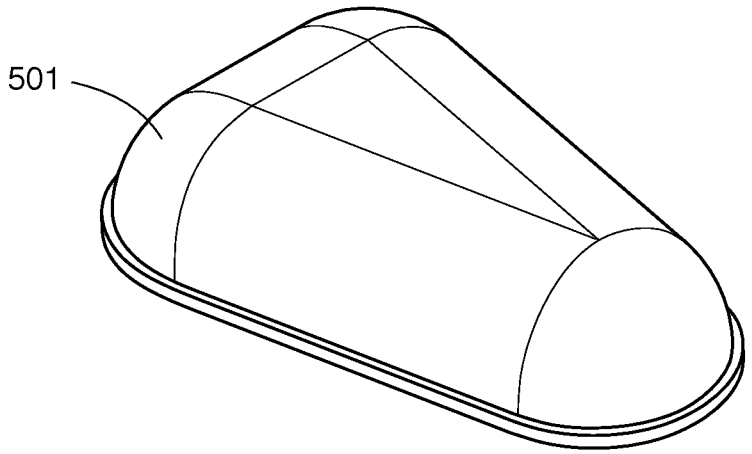
FIG. 5*b* is an orthographic view of the earbud storage shape.

FIGS. 5*a* and 5*b* show a non-oblong shape being used for the cover (501) to allow earbud audio devices (509) and their cord (507) to be stored in another embodiment of the invention. The shape of the platform that forms the bottom of the cavity mimics the outline of the cover and is attached to the cover via posts (503) and in a similar manner to the first embodiment with bosses and holes in the center of the posts (505). Depending on the corded device to be stored, the shape of the cover can be modified as appropriate for the corded device and bistable nature of the cover.

Figure 6A:
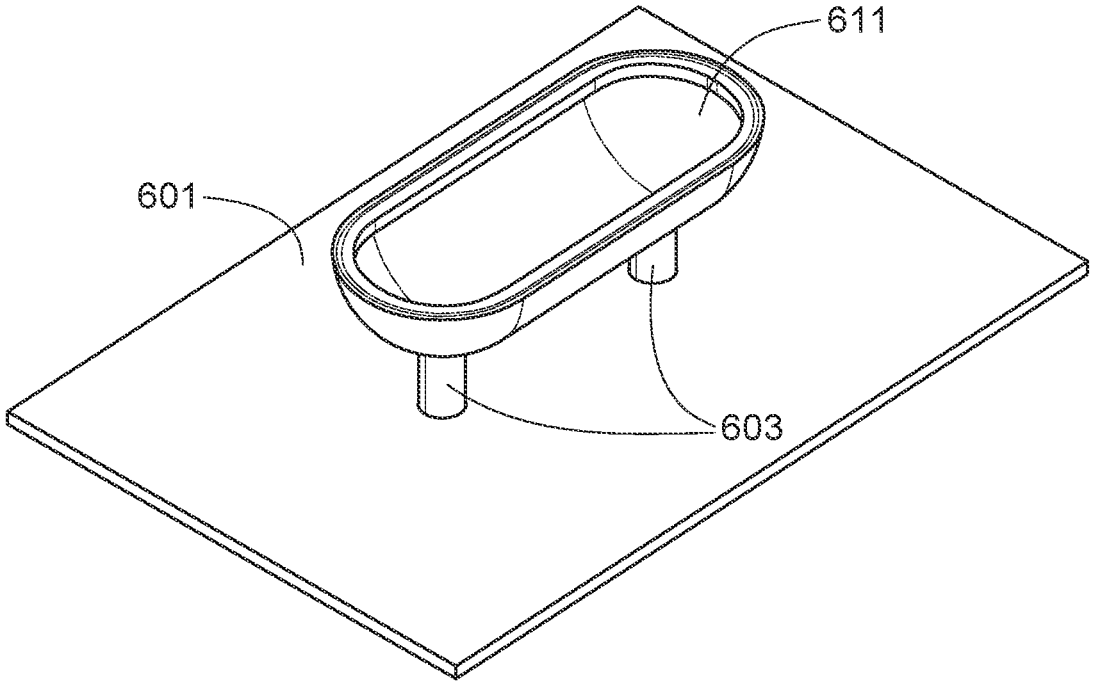
FIG. 6*a* is an orthographic view of an embodiment where the platform extends beyond the cover and the cover is in the open position.
Figure 6B:
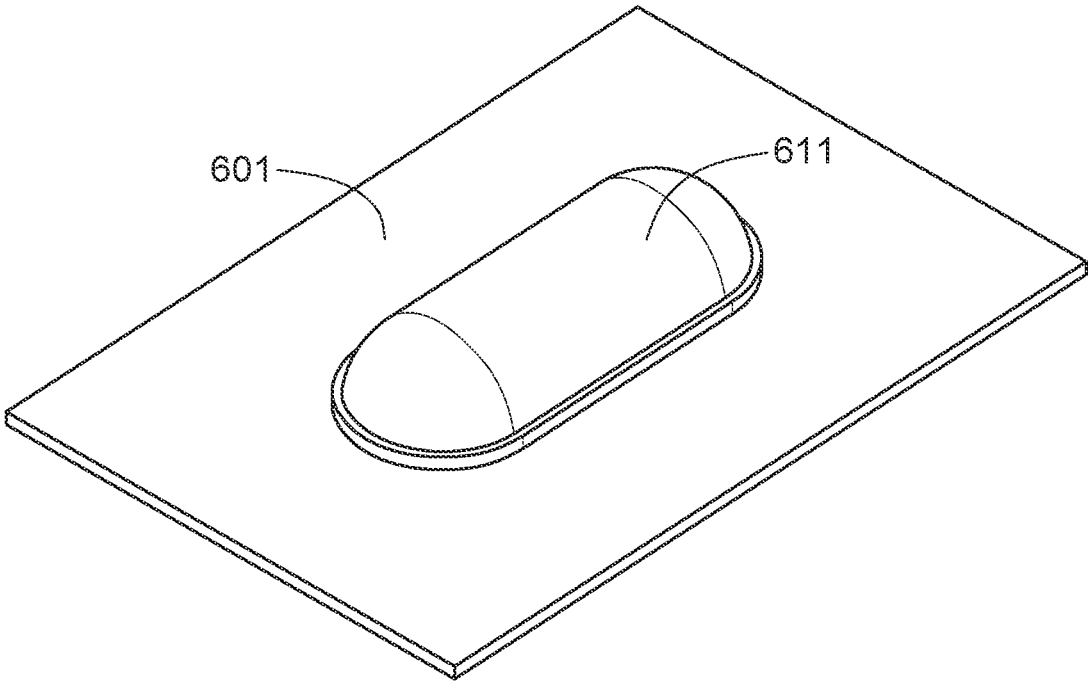
FIG. 6*b* is an orthographic view of the embodiment of 6*a* where the cover is in the closed position.

FIGS. 6*a* and 6*b* show an embodiment where the platform (601) extends beyond the edges of the cover (611). FIG. 6*a* shows the cover in the open position, allowing access to the orthogonal posts (603) around which the cable is wound. The cover (611) is retained in a similar manner as the first embodiment. Inverting the cover to the closed position shown in FIG. 6*b* creates the cavity where the cable is stored.

In the description above and throughout, numerous specific details are set forth in order to provide a thorough understanding of an embodiment of this disclosure. It will be evident, however, to one of ordinary skill in the art, that an embodiment may be practiced without these specific details. In other instances, well-known structures and devices are shown in block diagram form to facilitate explanation. The description of the preferred embodiments is not intended to limit the scope of the claims appended hereto. Further, in the methods disclosed herein, various steps are disclosed illustrating some of the functions of an embodiment. These steps are merely examples, and are not meant to be limiting in any way. Other steps and functions may be contemplated without departing from this disclosure or the scope of an embodiment.

What is claimed is:

1. A cable storage device comprising:

a flat platform body with at least two posts around which a cable can be wound, each of the two posts comprising (1) a first end fixedly attached to the flat platform body and (2) a second end fixedly attached to a flexible cover that is curved along at least two axes, the flexible cover being invertible and having two stable positions, a closed convex position and an open concave position, a cable storage cavity being created by inverting the flexible cover from the open position to the closed position, wherein the closed position exposes a first outer surface of the invertible flexible cover and consists of the edges of the invertible flexible cover contacting the platform thereby defining the cable storage cavity, and wherein the open position exposes an inner surface of the invertible flexible cover as a second outer surface and allows the cavity to be filled with the cable to be stored.

2. The cable storage device of claim 1 wherein the flexible cover has a notch on the perimeter that allow the cable ends to protrude outside the cover when the cover is closed.

3. The cable storage device of claim 1 wherein the at least two posts are divided to allow a cable to pass between the divided posts and retain said cable when the cover is attached.

4. The cable storage device of claim 1 wherein the cover has a shape to allow the cover to protect devices that have attached cords.

5. A method for storing and transporting cables using a cord storage device comprising the steps:

winding a cable around at least one post, the at least one post fixedly attached to a platform and a multi-axis curved flexible cover, the flexible cover being invertible and having a concave configuration;

inverting the flexible cover attached to the at least one post, wherein the inverted flexible cover has a convex configuration and creates a cavity, the convex configuration of the cover enclosing the cable in the cavity defined by the cover and the platform.

6. The method of claim 5 wherein notches are placed in the cover to allow the cable ends to protrude, allowing for storage of excess cable when the cable is in use.

7. The method of claim 5 wherein the at least one post is modified to allow the cable to be retained by the cord storage device such that said device cannot be misplaced while the cable is being used.

8. The method of claim 5 wherein the shape of the cover allows the storage of devices attached to the cables.

* * * * *